US005168810A

United States Patent [19]

Kojima

[11] Patent Number: 5,168,810

[45] Date of Patent: Dec. 8, 1992

[54] PLATE ADJUSTING MECHANISM FOR LEAF-TYPE PRINTING MACHINE

[75] Inventor: Yasutaka Kojima, Tokyo, Japan

[73] Assignee: Akiyama Printing Machine Manufacturing Company Ltd., Tokyo, Japan

[21] Appl. No.: 557,528

[22] Filed: Jul. 24, 1990

[30] Foreign Application Priority Data

Sep. 13, 1989 [JP] Japan ..... 1-238056
Feb. 22, 1990 [JP] Japan ..... 2-41483

[51] Int. Cl.[5] ..... B41F 1/28
[52] U.S. Cl. ..... 101/415.1; 101/378
[58] Field of Search ..... 101/378, 383, 415.1, 101/DIG. 36

[56] References Cited

U.S. PATENT DOCUMENTS 2,236,230 3/1941 Worthington ..... 101/378
2,578,406 12/1951 Dutro ..... 101/415.1
2,768,579 10/1956 Fies ..... 101/415.1
4,408,529 10/1983 Johne et al. ..... 101/415.1
4,759,287 7/1988 Shizuya ..... 101/415.1 X
4,862,800 9/1989 Wieland et al. ..... 101/415.1
4,938,135 7/1990 Wieland ..... 101/415.1
4,977,833 12/1990 Inage et al. ..... 101/415.1

FOREIGN PATENT DOCUMENTS 0174156 7/1987 Japan ..... 101/415.1

*Primary Examiner*—Edgar S. Burr
*Assistant Examiner*—Christopher A. Bennett
*Attorney, Agent, or Firm*—Bauer & Schaffer

[57] ABSTRACT

A plate adjusting mechanism for a leaf-type printing machine is provided to shift a plate wrapped around a plate roller. The top side plate clamp is pivoted about a fulcrum located at one end, and an actuator is mounted on the end of the plate roller. The actuator is arranged to move the top side plate clamp and thereby pivot the same.

7 Claims, 11 Drawing Sheets

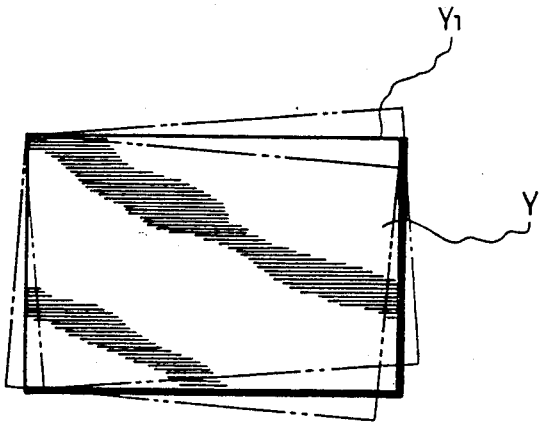
FIG. 2(2)
FIG. 3
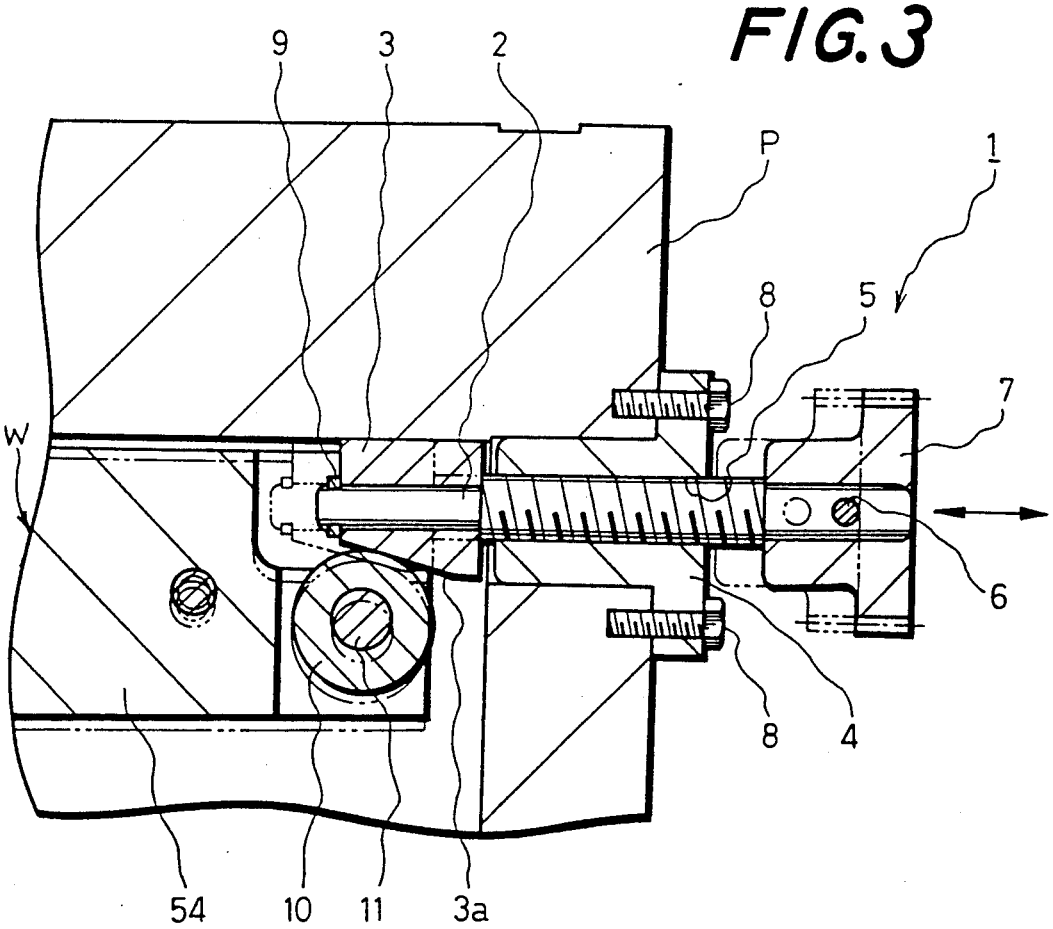

PLATE ADJUSTING MECHANISM FOR LEAF-TYPE PRINTING MACHINE

BACKGROUND OF THE INVENTION

1. Field of the Invention

This invention relates to a plate clamping apparatus for leaf-type printing machines, and more particularly, to a mechanism for shifting a plate wrapped around the plate roller of a printing machine in order to adjust the position of the plate so as to eliminate shears in printing.

2. Description of the Prior Art

In a multiple color leaf-type printing machine, which prints multiple colors on a single leaf of paper, plates should be wrapped around respective plate rollers with as little shear as possible so that the positions of the patterns printed by the respective printing units coincide and precise elegant printed matter is obtained.

The plate clamping apparatus of a conventional leaf-type printing machine, for example as shown in FIGS. 1(1) and 1(2), is accommodated in a recess 29 formed in the axial direction of a plate roller P and comprises as its main component a top side plate clamp W, a bottom side plate clamp S, and a plate stretcher for stretching a plate Y wrapped around the plate roller P.

The plate Y is attached in this conventional plate clamping apparatus as follows:

First, the notches of a top side cam shaft 51 and a bottom side cam shaft 55 are directed upwardly by a tool which is suspended from tool suspenders 28*a* and 28*b* so that the tip of top side upper teeth 53 and bottom side upper teeth 57 are lifted and opened, being urged by the force of springs 36 and 37, using spherically headed bolts 25*a* and 25*b* as fulcrum. The bottom side plate clamp S is offset toward the bottom side lateral wall 56 when the notch of a plate stretching cam shaft 59 is directed to the top of respective fine adjustment bolts 52*e*, 62*f*, 62*g*, and 62*h* since the tops of the fine adjustment bolts 62*e*, 62*f*, 62*g*, and 62*h* are pressed against the plate stretching cam shaft 59. Next, the plate roller P is rotated to a position at which the top end of the plate Y can be readily inserted between the top side upper teeth 53 and top side lower teeth 54 of the top side plate clamp W. The top side cam shaft 51 is then rotated by manual operation to close the top side upper teeth 53 to thereby clamp the top end of the plate Y. When the clamping of the top end of the plate Y by the top side plate clamp W is completed, the plate roller P is rotated, with the plate Y closely contacting the peripheral surface of the plate roller P, to a position where the bottom end of the plate Y can be easily attached to the bottom side plate clamp S. At this position, the bottom end of the plate Y is inserted between the bottom side upper teeth 57 and bottom side lower teeth 58. The bottom side cam shaft 55 is then rotated by manual operation to close the bottom side upper teeth 57 and accordingly clamp the bottom end of the plate Y. Next, the plate stretching cam shaft 59 is rotated by a tool, which is suspended from the tool suspender 28*c* at the end of the cam shaft 59, and the bottom side clamp S is moved away from the bottom side lateral wall 56. As a result, the plate Y is stretched to closely contact the peripheral surface of the plate roller P. Incidentally, removal of the plate Y is achieved by reversing the above-mentioned procedure.

With the plate Y thus wrapped around the plate roller P, a trial printing is performed to examine for shears in the respective colors. A shear in the vertical direction, i.e. in the direction which the paper is transported, is eliminated by adjusting respective fine adjustment bolts 62*a*, 62*b*, 62*c*, 62*d*, 62*e*, 62*f*, 62*g*, and 62*h*. A shear in the horizontal direction, i.e. the direction perpendicular to the paper transporting direction, is eliminated by rotating adjusting bolts 61*a*, 61*b*, 61*c*, and 61*d* for the top and bottom sides. Specifically, to move the top side plate clamp W toward the left as seen in FIG. 1, the adjusting bolt 61*a* on the top side is rotated away form the adjacent lateral wall of the plate P to form a gap between its head and the lateral wall. Nest, by rotating the adjusting bolt 61*b* while its head is in contact with the other lateral wall of the plate roller P, the top side plate clamp W is moved toward the left by the necessary amount. After movement by the necessary amount, the adjusting bolt 61*a* is rotated until its head comes into contact with the lateral wall of the plate roller P. Selective movement of the top side plate clamp W in the left or right direction is limited by the adjusting bolts 61*a* and 61B when the heads are in contact with one and the other lateral sides of the plate roller P.

Next, the procedure of lowering the top left side of the plate Y will be explained. First, the adjusting bolts 61*a*, 61*b*, 61*c*, and 61*d* are rotated to form a narrow gap between the head of the respective adjusting bolts and the side walls of the recess 29. Next, the fine adjustment bolts 62*e*, 62*f*, 62*g*, and 62*h* on the bottom side are rotated to bring the bottom side plate clamp S close to the bottom side lateral wall 56. As a result, the left side gap portion becomes wider while the right side gap portion becomes very narrow. Then, the fine adjustment bolts 62*a*, 62*b*, 62*c*, and 62*d* on the top side are respectively rotated such that the top side plate clamp S is moved away from the top side lateral wall 52, whereby the left side gap becomes wider while the right side gap becomes very narrow. In other words, the fine adjustment bolts are rotated in a manner that the top side plate clamp W is moved by the amount by which the bottom side plate clamp S was brought close to the bottom side lateral wall 56, thereby making it possible to shift the plate Y for adjustment. When the plate Y has been shifted as mentioned above, the fine adjustment bolts 62*a*, 62*b*, 62*c*, and 62*d* are rotated in the opposite direction to bring the heads of the respective fine adjustment bolts into contact with the side wall of the recess 29 to limit lateral movement of the plate clamps S and W, thus, terminating a shifting procedure for the plate Y in one direction. It will be understood that a shift of the plate Y in the opposite direction can also be achieved in the same manner as explained above.

Thus, in order to adjust the position of the plate in the conventional apparatus, complicated and time-consuming manual work such as fastening and loosening multiple fine adjustment bolts with a tool is required. Also, since the adjustment procedure includes many steps, the operator must be well-experienced in the adjustment. In addition, since such work is done in a small place and at a relatively elevated position, the work cannot be completed in a short amount of time. Further, since the adjustment must be carried out by manual operation, it is not possible to provide a high working efficiency and favorable adjustment efficiency.

OBJECTS AND SUMMARY OF THE INVENTION

In view of the above-mentioned problems, it is an object of the present invention to provide a mechanism for shifting a plate to adjust the position thereof for a leaf-type printing machine, which allows even a less experienced operator to easily achieve such adjustment within a short amount of time.

To achieve the above object, the present invention provides plate adjusting mechanism for a leaf-type printing machine having a top side plate clamping apparatus and a bottom side plate clamping apparatus, characterized in that the side end portion of the top side plate clamping apparatus is rotatable in order to shift the plate.

The above and other objects, features, and advantages of the present invention will become more apparent from the following detailed description when taken in conjunction with the accompanying drawings in which preferred embodiments of the present invention are shown by way of illustrative examples.

BRIEF DESCRIPTION OF THE DRAWINGS

FIG. 1(2) is a cross-sectional view taken along a line E—E of FIG. 1(1);

FIG. 2(2) is a side view showing how a plate is shifted;

FIGS. 3 and 4(1)–4(4) are partially enlarged cross-sectional views, respectively showing a main portion of the mechanism according to the present invention;

DETAILED DESCRIPTION OF THE PREFERRED EMBODIMENTS

Now, the preferred embodiments and other embodiments of the present invention will hereinafter be explained with reference to FIGS. 2 through 11.

Figure 1:
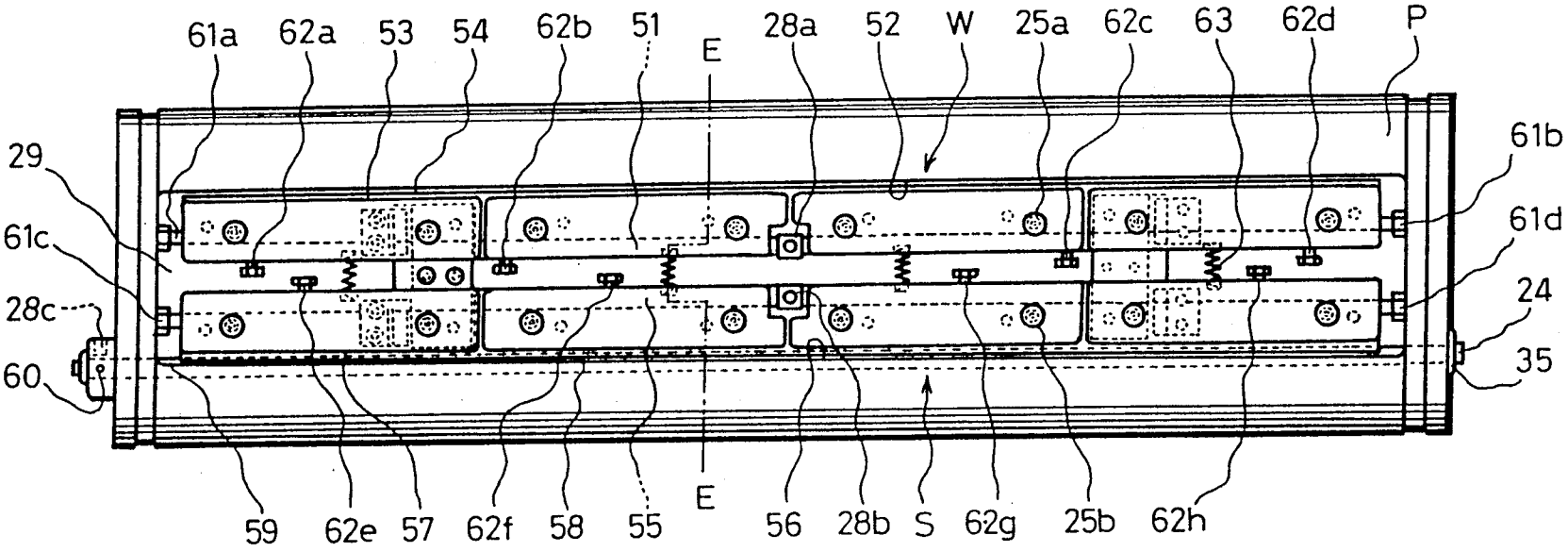
FIG. 1(1) PRIOR ART
FIG. 1(1) is a plan view showing a conventional plate clamping apparatus for the purpose of comparing with the apparatus shown in FIG. 2(1)
Figure 1:
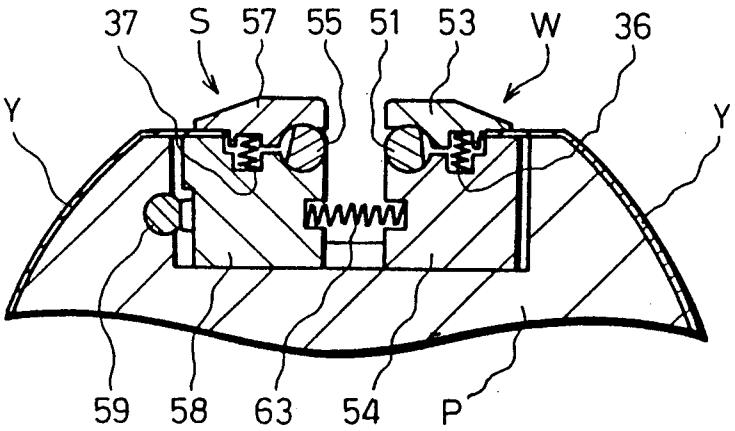
FIG. 1(2) PRIOR ART
Figure 2:
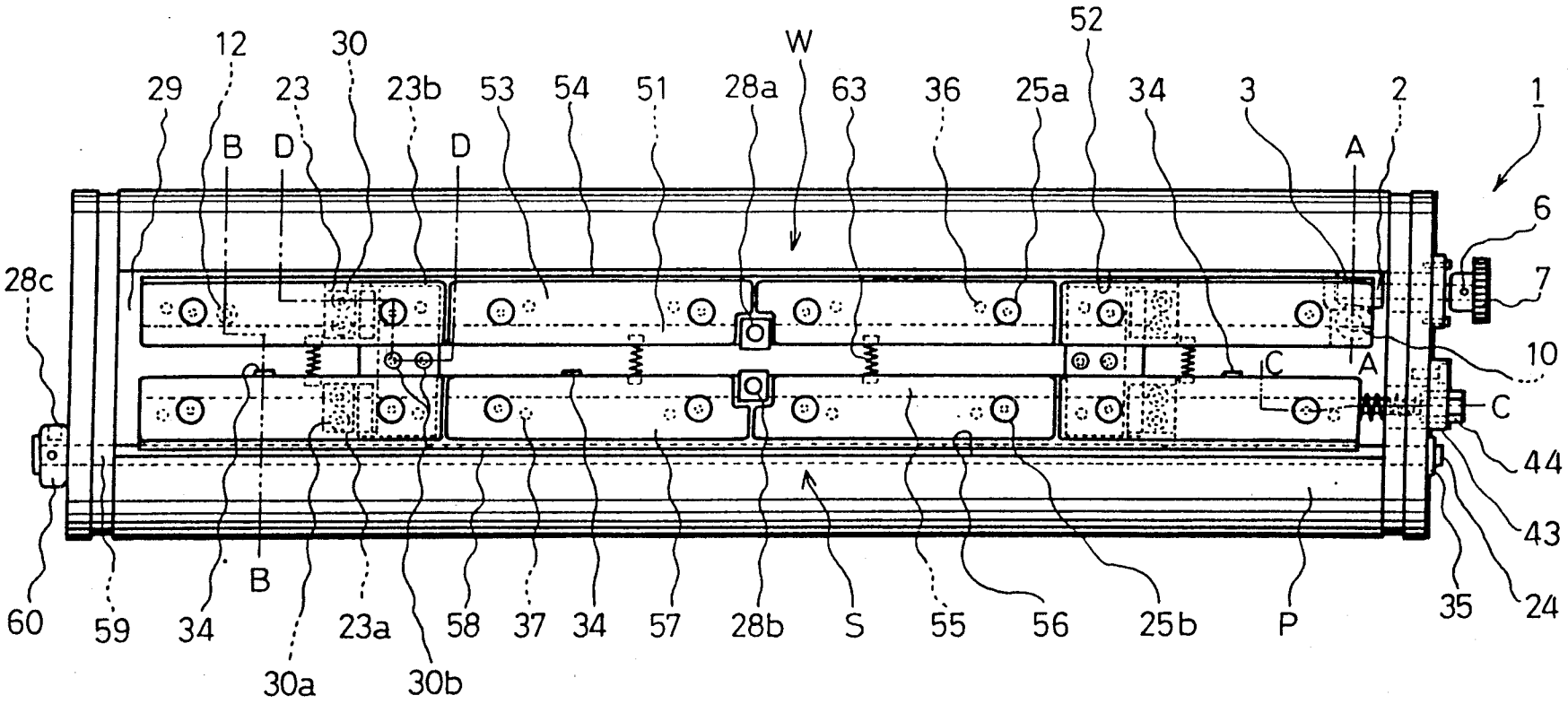
FIG. 2(1) is a plan view showing a plate shifting mechanism according to the present invention mounted on a plate clamping apparatus of a conventional leaf-type printing machine.

FIGS. 2(1) and 2(2) show the plate shifting mechanism of the present invention incorporated in a plate clamping apparatus of an otherwise leaf-type printing machine. The plate clamping apparatus is formed of a top side plate clamp W, a bottom side plate clamp S and a plate stretcher—that is, it basically has the same structure as the conventional apparatus shown in FIG. 1. However, as is apparent from a comparison of both drawings, the plate clamping apparatus of FIG. 2 does not have adjusting bolts 61*a*, 61*b*, 61, and 61*d* and fine adjustment bolts 62*a*, 62*b*, 62*c*, 62*d*, 62*e*, 62*f*, 62*g*, and 62*h*, as does the conventional plate clamping apparatus of FIG. 1. Thus, the present invention is characterized in that the position of a plate Y is not adjusted by these adjusting bolts and fine adjustment bolts but by the novel plate shifting mechanism.

The top side plate clamp W is provided with top side upper teeth 53, divided into four portions, and top side lower teeth 54, between which are interposed a spring 36 and a top side cam shaft 51. A tool suspender 28*a* is mounted at a substantially central portion of the top side cam shaft 51. The top side upper teeth 53, top side lower teeth 54, and top side cam shaft 51 are assembled by a spherically headed bolt 25*a*.

The bottom side plate clamp S is provided with bottom side upper teeth 57, divided into four portions, and bottom side lower teeth 58, between which a spring 37 and a bottom side cam shaft 55 are interposed. Also, a tool suspender 28*b* is mounted on the bottom side cam shaft 55. The bottom side upper teeth 57, bottom side lower teeth 58, and bottom side cam shaft 55 are assembled by a spherical headed bolt 25*b*, in the same manner as the top side clamp W.

A plate stretcher is provided with a plate stretching cam shaft 59 between the bottom side lower teeth 58 of the bottom side plate clamp S and U-shaped groove of the plate roller P. The cam shaft 59 includes a notch in which a spring 63 is arranged between the top side lower teeth 54 and the bottom side lower teeth 58.

The plate stretching cam shaft 59 is supported in the side walls of the plate roller P and retained by a tool suspender 28*c* at one end, while at the other end it is fixed by a washer 36 and cap bolt 24. The plate stretcher cam shaft 59 is therefore restricted in its movement in the axial direction by the tool suspender 28*c* and the washer 35. Also, the plate stretcher cam shaft 59 is rotatable by a tool suspended at the tool suspender 28*c*.

Adjustment of the position of the plate according to the present invention comprises a shifting mechanism mounted in the vicinity where the adjusting bolt 61*b* of the conventional apparatus as shown in FIG. 1 would normally be. The shifting mechanism 1 is operable to pivot the top side plate clamp W (the left side in FIG. 2(1)) about a fulcrum pin 12, to thereby adjust the position of the plate Y as seen in FIG. 2(2).

FIG. 3 is an enlarged cross-sectional view showing the main portion of the plate shifting mechanism 1 of the present invention. The plate shifting mechanism 1 comprises a gear 7 fixed at the end of a shaft 2 on which is mounted a wedge 3. The shaft 2 is rotatable in a bearing 4 having an internal thread 5 and is fixed to the end wall of the roller plate P. The wedge 3 has one surface, which slides along the inner surface of the plate roller P, and an opposite sloping surface 3*a*. The wedge 3 is arranged to fit within the end (the right side in FIG. 3) of the top side plate clamp W, i.e. in a cutout in the top side lower teeth 54. The gear 7 is mounted on the moving shaft 2 by a taper pin 6 and may be rotated manually or remotely.

When the gear 7 is rotated, the shaft 2 is moved axially by the cooperation of the threaded portion 5 of the bearing 4. A ball bearing 10 is attached to the top side lower teeth 54 by a pin 11 to bear against the sloping surface 3*a*. The ball bearing 10 reduces the slide resistance between the top side plate clamp w and the wedge 3, and therefore, the top side plate clamp W is caused to pivot smoothly about the pin 12, in response to advancing and retreating movement of the wedge 3. Explaining more specifically, rotation of the gear 7 cause the shaft 2 to advance or retreat, and accordingly, the wedge 3 in contact with the ball bearing 10 rolls along the sloping surface 3*a* of the wedge 3. Since the top side plate clamp W is biased by the spring 63, it is continually urged against the sloping surface 3*a* and, consequently, is moved vertically as seen in FIG. 2(2) by action of the wedge 3. The wedge 3 has a stopping ring 9 which prevents the wedge 3 from coming off the shaft 2. The bearing 4 is fixed to the plate roller P by bolts 8.

Next, the present embodiment will be explained further in detail with reference to FIGS. 4(1)–4(4).

Figure 4:
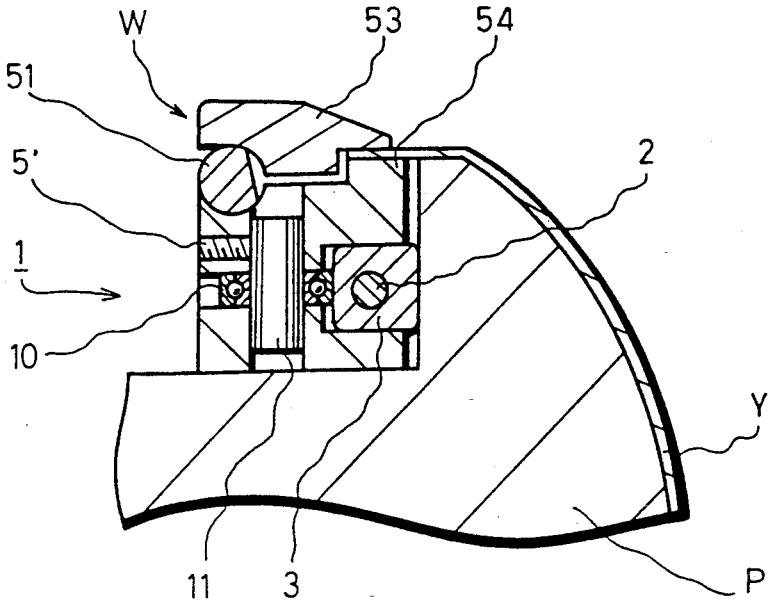
Figure 4:
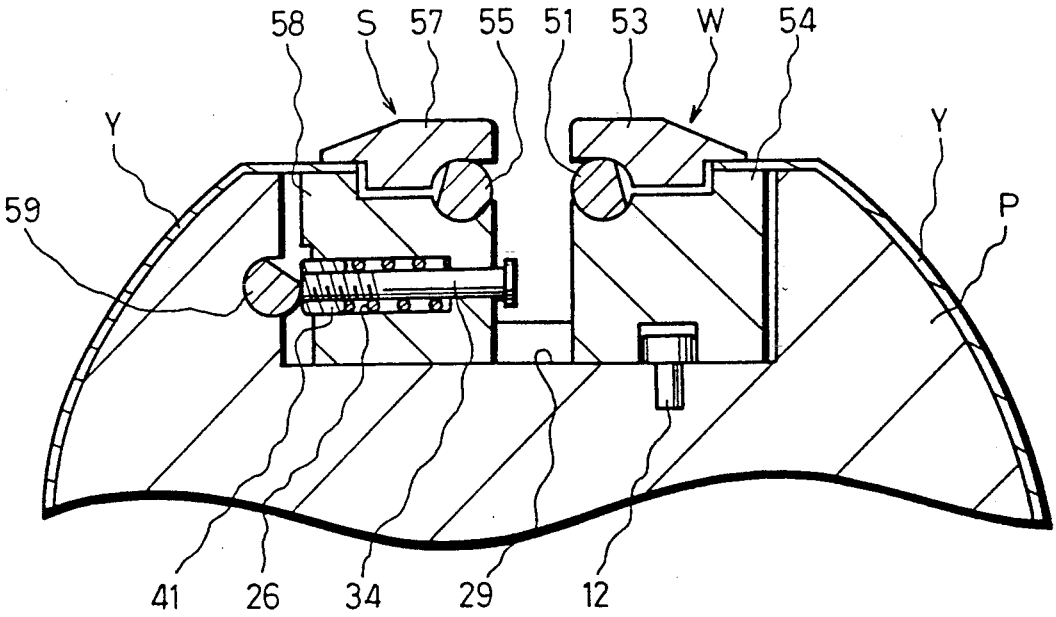
Figure 4:
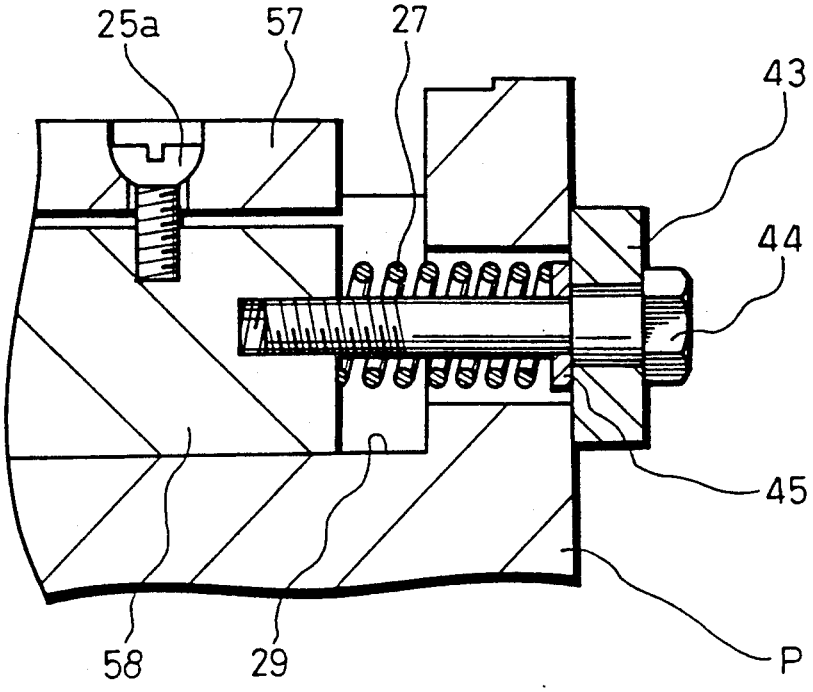
Figure 4:
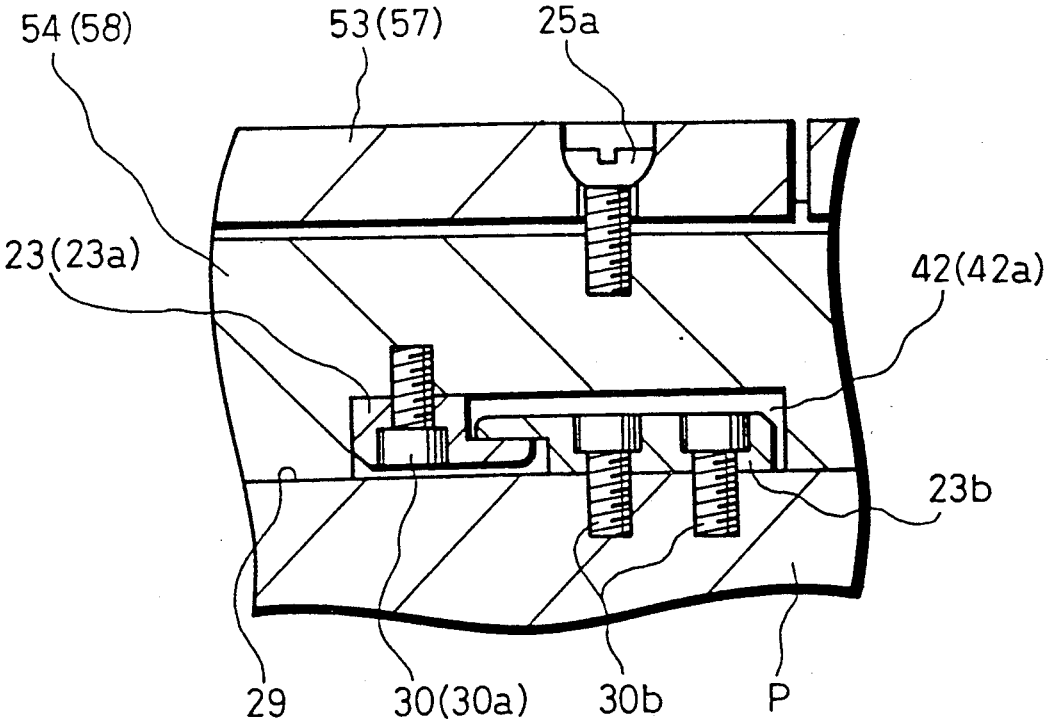

FIG. 4(1) is an enlarged cross-sectional view of a main portion of the plate clamping apparatus of FIG. 2, taken along a line A—A drawn in FIG. 2(1). As is apparent from a comparison with FIG. 1(2), the plate shifting mechanism 1 is arranged in a portion of the top side lower teeth 54. Specifically, the ball bearing 10 is arranged in the top side lower teeth 54, fixed by the pin 11, which in turn is secured by a bolt 5'.

FIG. 4(2) is a cross-sectional view taken along a line drawn B—B in FIG. 2(1). The top side lower teeth 54 is pivotably supported on the bottom surface of the recess 29 of the plate roller P by the fulcrum pin 12. The bottom side lower teeth 58 is provided with a spring guide pin 34 through a spring receiving collar 41. A spring 26 is interposed between the spring receiving collar 41 and the bottom side lower teeth 58 for preventing the plate Y from being excessively stretched.

FIG. 4(3) is a cross-sectional view taken along a line C—C drawn in FIG. 2(1) which shows a section for adjusting the bottom side plate clamp S in the axial direction of the plate roller P. An adjusting bolt 44 is provided through a receiving plate 43 on the outer wall of the plate roller P. The threaded end portion of the adjusting bolt 44 meshes with a threaded bore in the bottom side lower teeth 58. A spring 27 and a washer 45 are interposed between the bottom side lower teeth 58 and the receiving plate 43.

FIG. 4(4) is a cross-sectional view taken along a line D—D drawn in FIG. 2(1) and shows a section for preventing the top and bottom side plate clamps W and S from coming out of the recess 29 of the plate roller P and also for restricting movement thereof in the recess 29. To perform the above functions, notches 42 and 42*a* are formed in the top side and bottom side lower teeth 54 and 58, respectively, and guide plates 23 and 23*a* are disposed in the notches 42 and 42*a* and fixed by bolts 30, 30*a*, respectively. Further, a guide plate 23*b*, which is arranged to slide along the guide plates 23 and 23*a* is mounted on the bottom surface of the recess 29 by a bolt 30*b*.

Reference is next made to the working procedure of the plate shifting mechanism 1 for a leaf-type printing machine constructed as described above. First, the plate Y is wrapped around the plate roller P, and after other preparations for printing are completed, a trial printing is performed. If the result of this trial printing shows that the plate Y should be adjusted, the plate Y is shifted by the following procedure.

Figure 5:
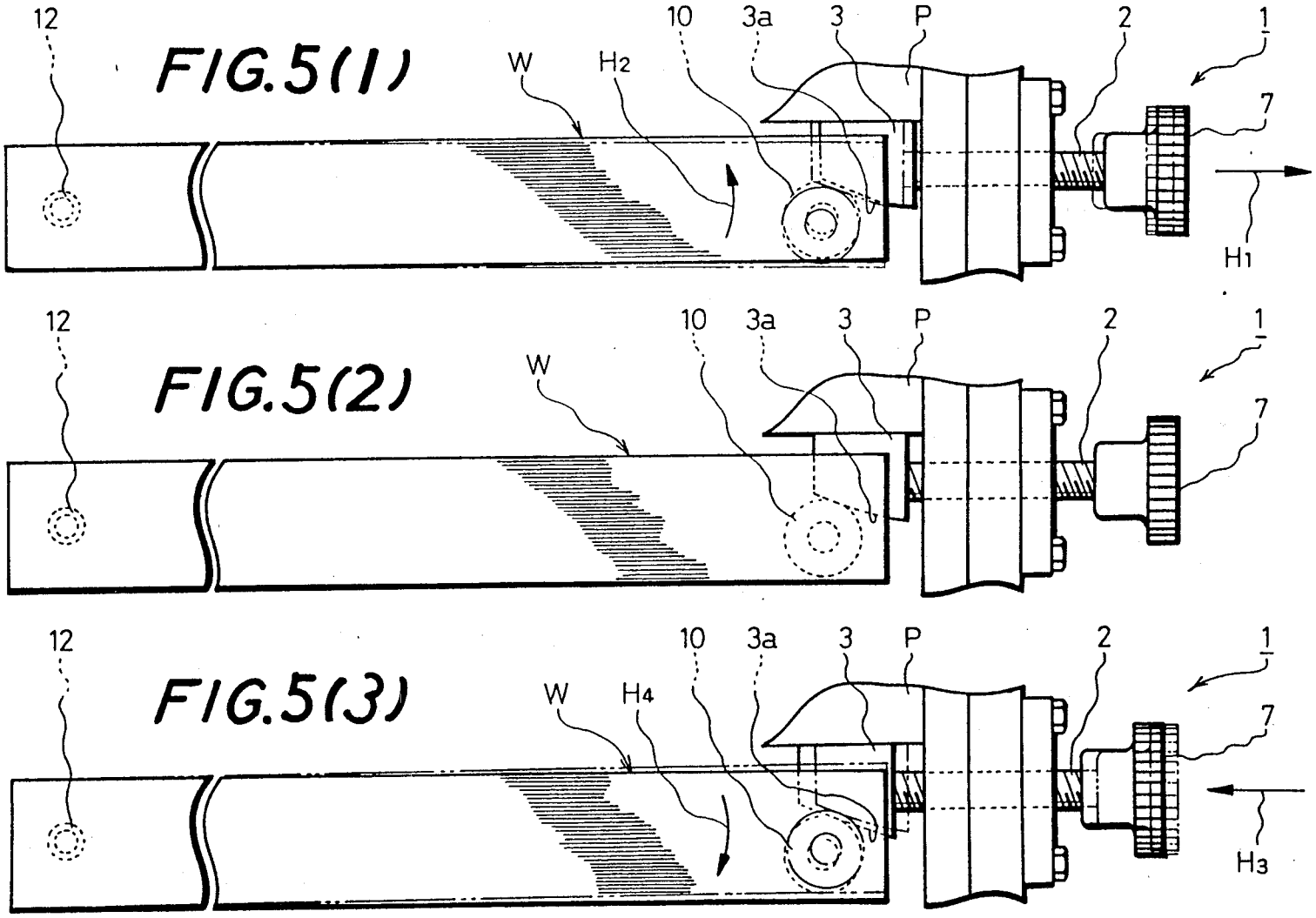
FIGS. 5(1)–5(3) are explanatory diagrams showing the operation of the plate clamping apparatus which employs the mechanism of the present invention.

The leaf-type printing machine is initially stopped, and one or more printing units which need adjustment of the plate Y are subjected to such adjustment. Specifically, the plate stretching cam shaft 59 (FIG. 2(1)) is rotated in the direction to loosen the plate Y, and the bottom side cam shaft 55 is rotated to open the bottom side upper teeth 57. Then, to shift the plate Y, the upper teeth 57 of the bottom side plate clamp S only is opened to release the plate Y while the top side plate clamp W keeps clamping the plate Y on the long side Y1 (FIG. 2(2)). This is because the whole plate Y can be moved without difficulty, as shown in FIG. 2(2). The rotating direction of the gear 7 is determined by the direction in which the plate Y is to be shifted. For example, as seen in FIG. 5(1). On rotating the gear 7 in the thus determined direction, e.g. as shown by arrow H1, the shaft 2 is axially moved. As the shaft 2 is moved, the wedge 3 is also moved in the same direction. Since the sloping surface 3*a* of the wedge 3 and the ball bearing 10 are always in contact with each other by the urging force of the spring 63, the top side lower teeth 54 are moved in the direction indicated by the arrow H2 with the fulcrum pin 12 being the center movement. Consequently, the plate Y is shifted as illustrated in FIG. 2(2).

Thereafter, when the gear 7 is rotated in an opposite direction to H1 and the wedge 3 is returned to the position indicated by the two dot chain line in FIG. 5(1)—that is, to the position illustrated in FIG. 5(2), then the top side plate clamp W is also returned to the initial position. When the gear 7 is further rotated in this opposite direction, the shaft 2 is moved inwardly in the direction of arrow H3 and the top side plate clamp W is swung in the direction of arrow H4, i.e. in the opposite direction to that shown in FIG. 5(1) with the result that the plate Y is further shifted.

Thus, the adjustment procedure is completed by shifting the plate Y by a predetermined amount as described above. After this adjustment procedure, the plate roller P and an associated bracket roller (not shown) are brought into printing condition. Specifically, the leaf-type printing machine is operated to rotate the plate roller P several times in contact with the bracket roller so that the adjusted plate Y is brought closely into contact with the peripheral surface of the plate roller P. After several rotations and when the bottom side plate clamp S is positioned in the vicinity of the contact point of the plate roller P and the bracket roller, the operation of the leaf-type printing machine is stopped. Then, the bottom side cam shaft 55 is rotated to close the bottom side upper teeth 57 and clamp the plate Y. Next, the plate stretching cam shaft 59 is rotated to stretch the plate Y, and the plate roller P is released from the contact with the bracket roller, thus completing the plate adjustment procedure.

As described above, the plate Y can be shifted for adjustment only by vertically moving one edge of the top side plate clamp by a manual or automatic operation of the gear 7. The mechanism of the present invention eliminates complicated and time-consuming manual operation of both the top and bottom side plate clamps W and S, as is required for adjustment of the plate Y is conventional leaf-type printing machines. Thus, if the result of a trial printing shows that a plate adjustment is required, such plate adjustment is quite easily achieved by rotating the gear by a driving apparatus (not shown) to automatically shift the plate Y by a necessary amount and in a desired.

Figure 6:
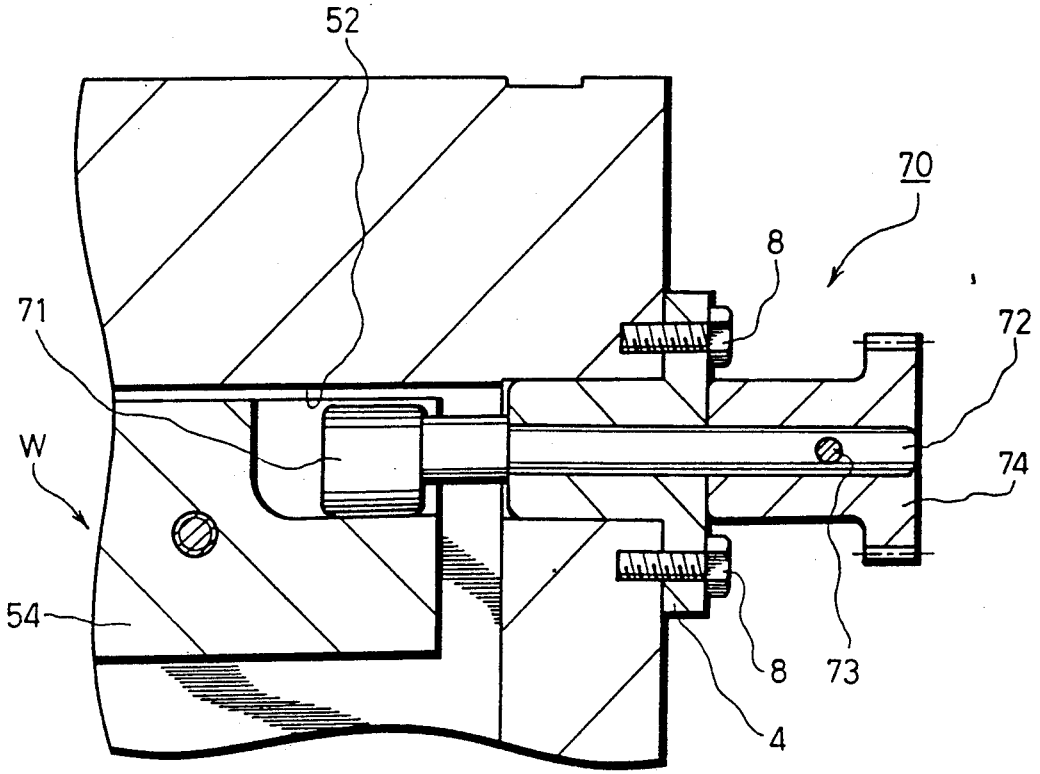
FIGS. 6(1), 6(2), 7(1)–7(3), and 8(1)–8(2) are cross-sectional views showing other embodiments of the present invention.
Figure 6:
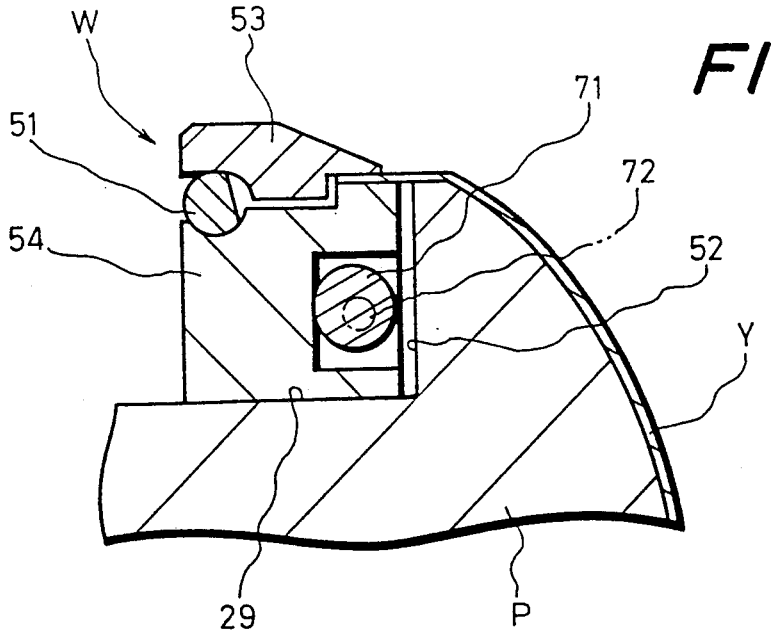

FIGS. 6(1), 6(2), and 7(1)–7(3) show a second embodiment of the present invention. In the second embodiment, the plate shifting mechanism 70 differs from the above-described first embodiment in that the second embodiment does not employ the ball bearing 10, the ball bearing pin 11, the stopper bolt 5', the wedge 3, and the stopping ring 9, but it comprises a plate clamp moving shaft 72 having at its end an eccentric cam 71, rotatably bearing on the interior wall of the plate roller P, in place of the axially sliding shaft 2. The eccentric cam 71 abuts with the end portion of the top side plate clamp W.

Figure 7:
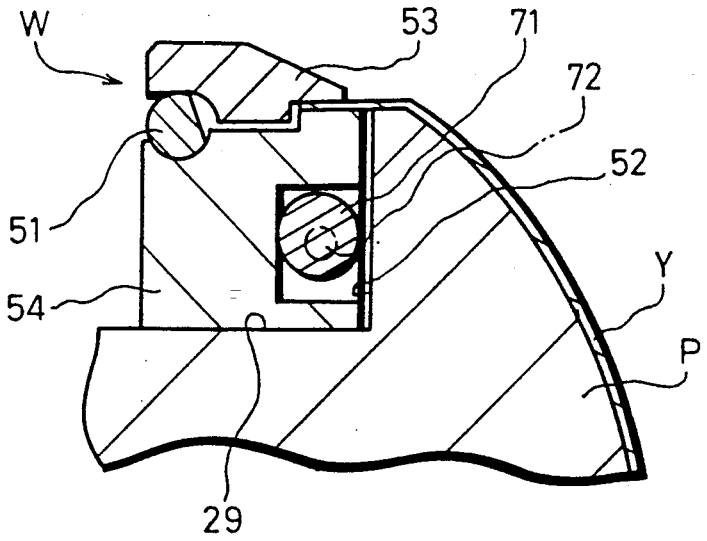
Figure 7:
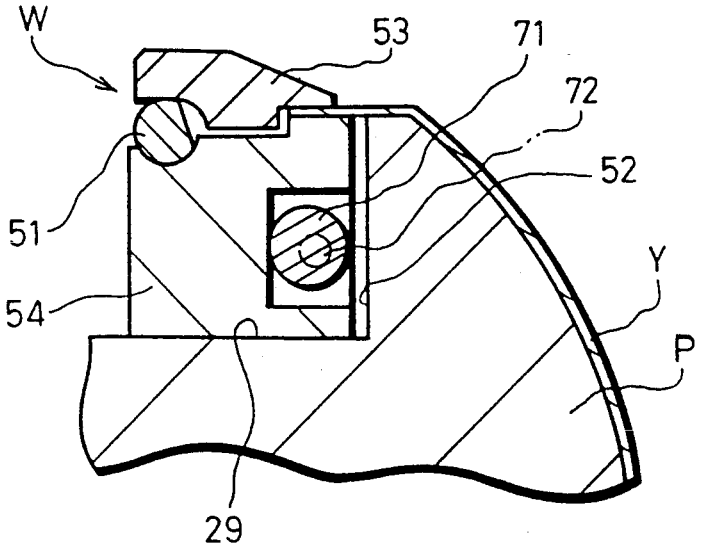
Figure 7:
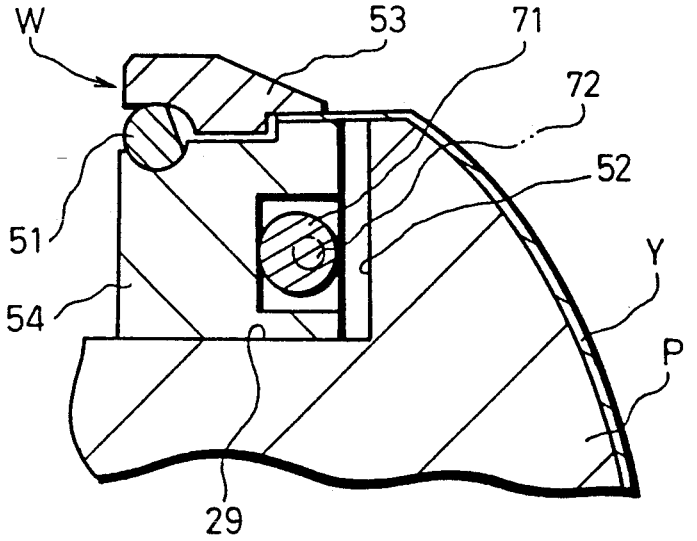

The shaft 72 is fixed to a gear 74 by a taper pin 73. Rotation of the gear 74 causes the eccentric cam 71 to be rotated and, consequently, pivot the plate clamp W about the fulcrum pin 12. FIGS. 7(1)–7(3) show such pivoting movement of the top side plate clamp W. Specifically FIGS. 7(1)–7(3) show the sequential positioning of the end of the top side plate clamp W closest to the side wall 52, at an intermediate position from the side wall 52 and furthest from the side wall 52, respectively. The other structure and operation of the second embodiment are identical to the first embodiment shown in FIGS. 2–5 so that the parts shown in FIGS. 6 and 7 and corresponding to those in FIGS. 2–5 are designated by the same reference numerals, and detailed explanation thereof is omitted.

Figure 8:
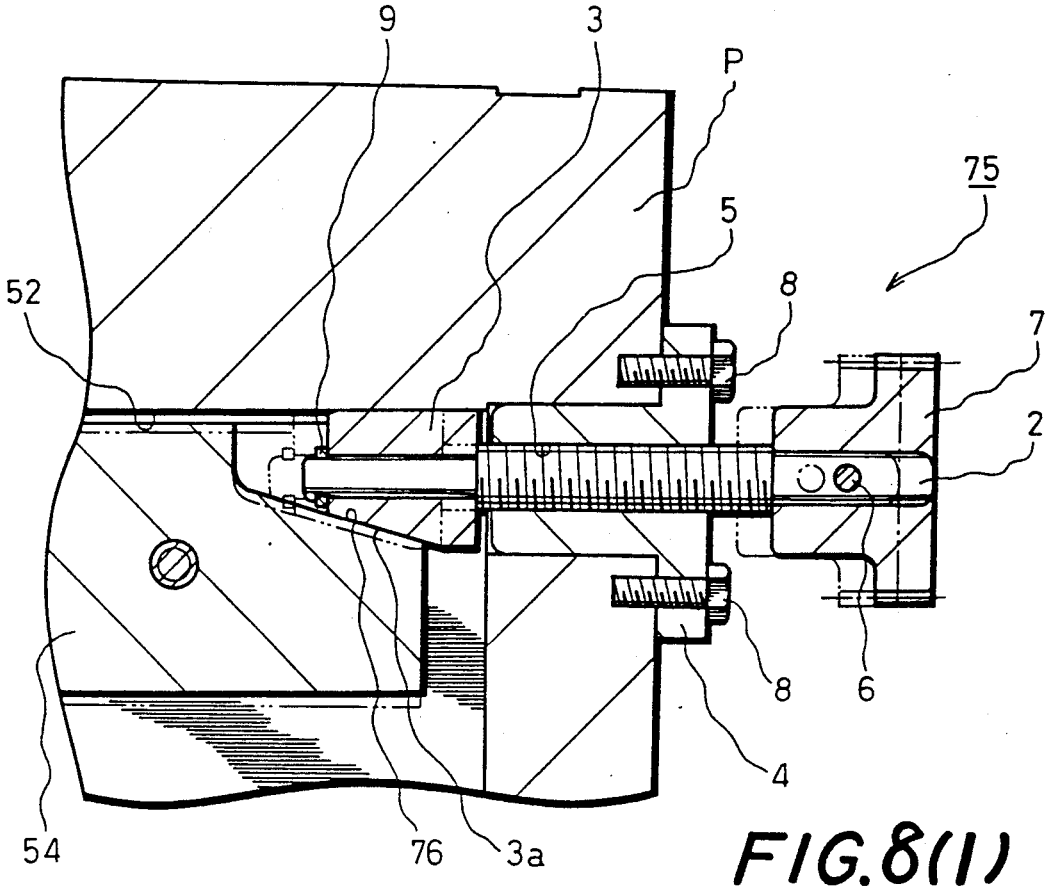
Figure 8:
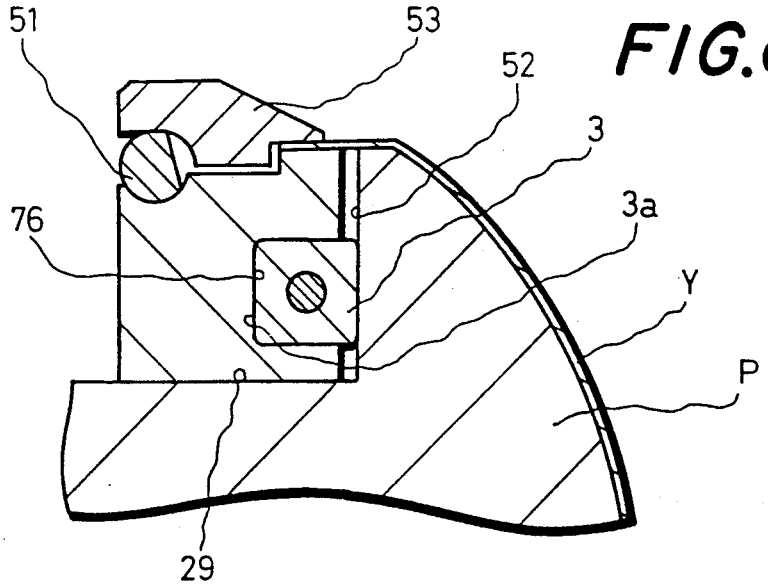
Figure 9:
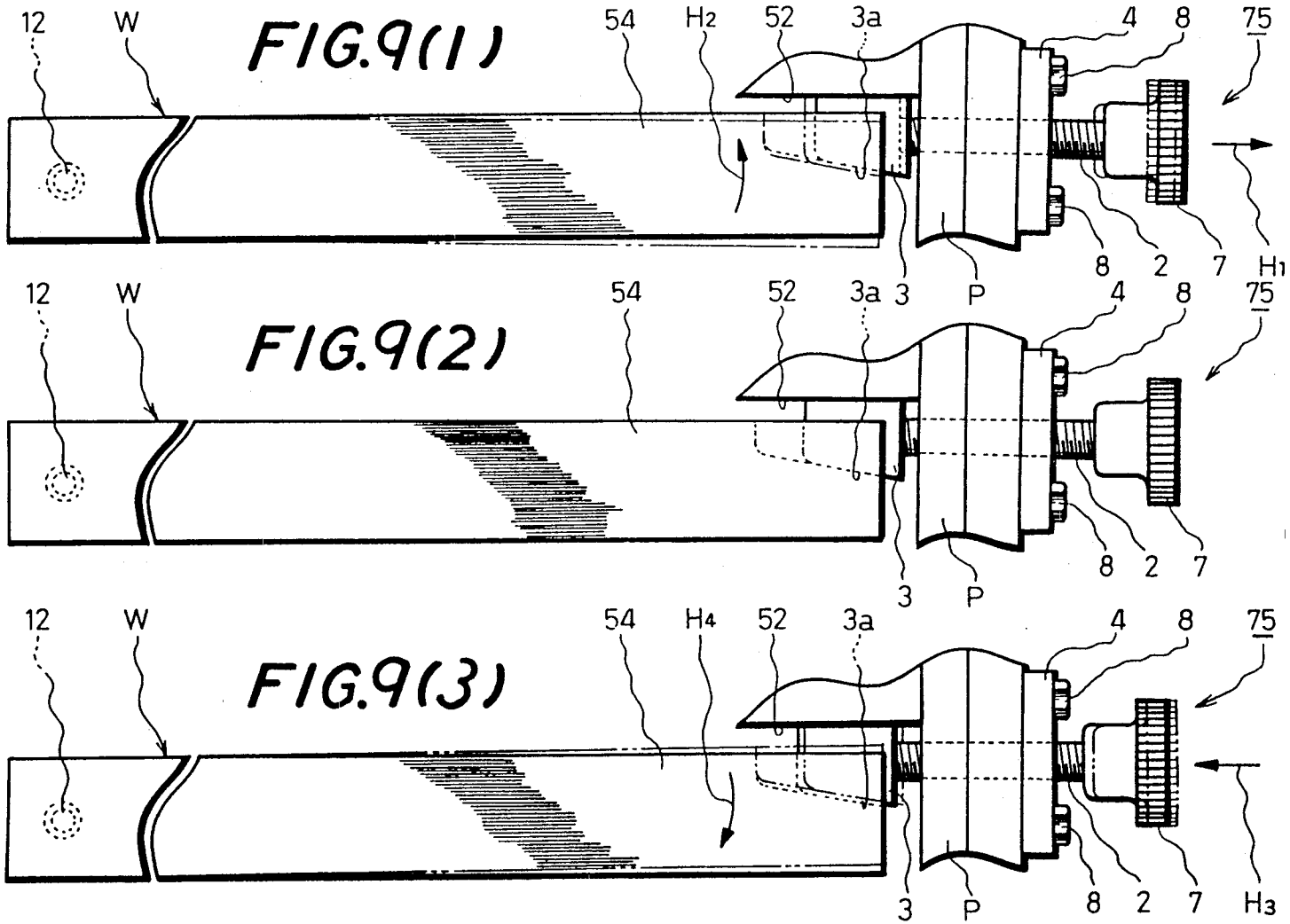
FIGS. 9(1)–9(3) are plan views showing operating conditions of another embodiment of the present invention.

FIGS. 8(1), 8(2), and 9(1)–9(3) show a third embodiment in which the plate shifting mechanism 75 differs from the first embodiment shown in FIGS. 2–5 in that the third embodiment does not employ the ball bearing 10, the ball bearing pin 11, and the stopper bolt 5', although it comprises a wedge 3 having sloping surface substantially equal to the aforementioned sloping surface 3*a* and which bears directly on a conformingly inclined surface 76 on the top side lower teeth 54 of the top side plate clamp W. The other structure and operation of the third embodiment are identical to the first embodiment shown in FIGS. 2–5 so that the parts shown in FIGS. 8 and 9 corresponding to those in FIGS. 2–5 are designated by the same reference numerals, and detailed explanation thereof will be omitted.

Figure 10:
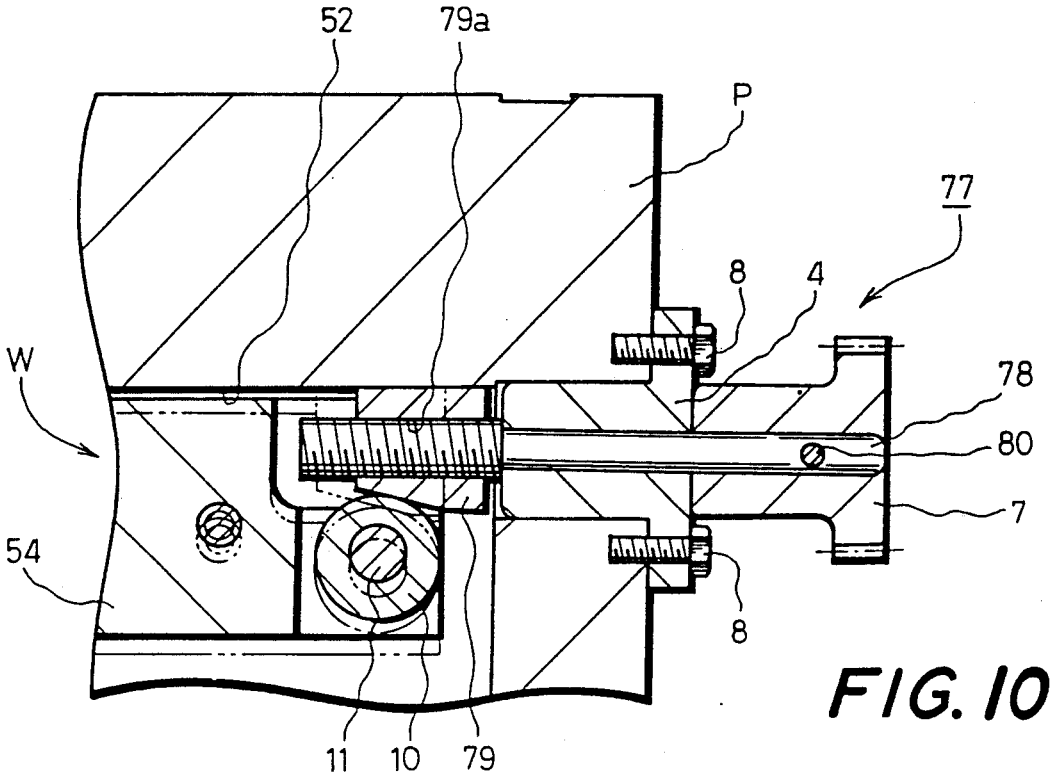
FIGS. 10 and 11 are cross-sectional views showing other embodiments of the present invention.

FIG. 10 shows a fourth embodiment of the present invention. A plate shifting mechanism 72 of FIG. 10 differs from the first embodiment shown in FIGS. 2–5 in that the bearing 4 does not have the threaded portion 5, and a shaft 78 is arranged merely to rotate in the bearing 4. The shaft 78, however, is threadedly engaged at its end portion 79*a* in a wedge 79 so as to advance and retreat the wedge 79. The wedge 79, having an inclined surface is in contact with the ball bearing 10. The gear 7, fixed to the shaft 78 by a taper pin 80, is rotated to advance and retreat the wedge 79 in the axial direction similar to the earlier embodiment, whereby the top side plate clamp W is pivoted about the fulcrum pin 12. The rest of construction and operation of the fourth embodiment are the same as those of the first embodiment shown in FIGS. 2–5 so that the corresponding parts in FIG. 10 are designated by the same reference numerals, and detailed explanation thereof will be omitted.

Figure 11:
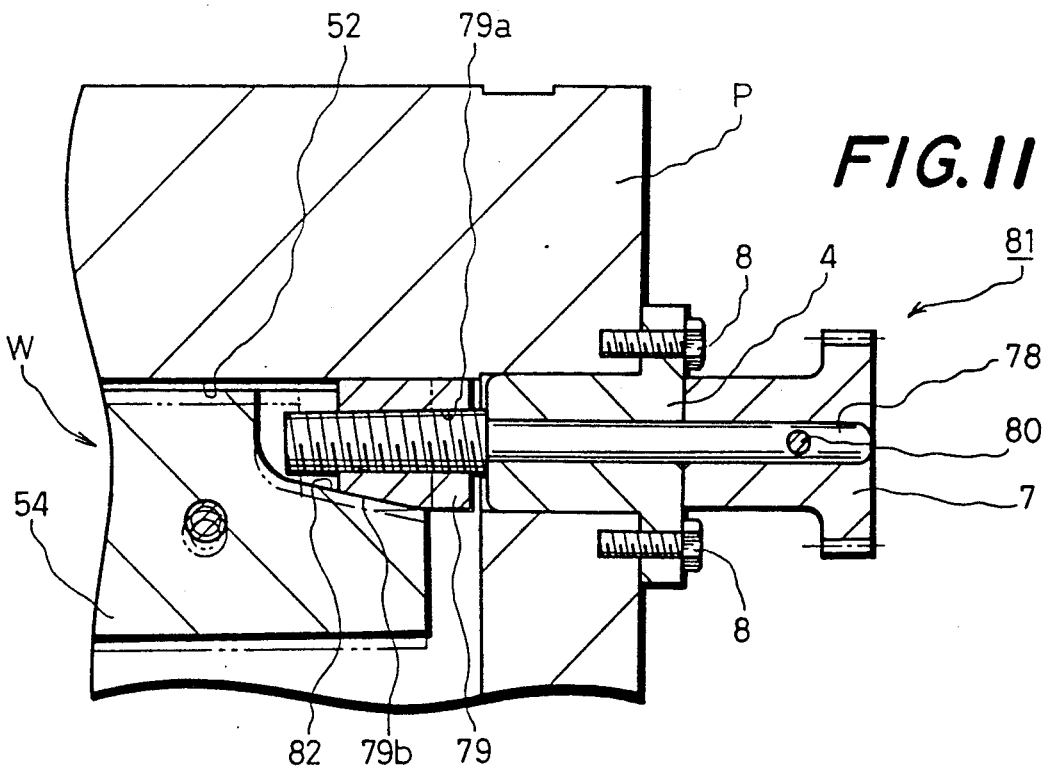

FIG. 11 shows a fifth embodiment of the present invention. The plate shifting mechanism 81 of FIG. 11 differs from the fourth embodiment of FIG. 10 in that the ball bearing 10 and the ball bearing pin 11 are not employed. A sloping surface 82 is provided on the wedge 79. The surface 82 is substantially identical to the sloping surface 79*b* on the top side lower teeth 54 of the top side plate clamp W. The sloping surface 82 bears on the sloping surface 79*b*. The rest of the construction and operation of the fifth embodiment are the same as those of the fourth embodiment so that the corresponding parts in FIG. 11 are designated by the same reference numerals, and detailed explanation thereof will be omitted.

In each of the foregoing embodiments, the fulcrum pin 12 is positioned at the opposite end of the top side plate clamp W; however, its position is not limited thereto. The fulcrum pin 12 may be positioned, e.g. in a longitudinal central portion of the top side plate clamp W.

Further, the plate shifting mechanisms 1, 70, 75, 77, and 81 are arranged in the top side plate W; however, they too may also be arranged in the bottom side plate clamp S.

In conclusion, the present invention produces the following effects:

1. The plate shifting mechanism of the present invention can remove the necessity of operating adjusting bolts and fine adjustment bolts, as is needed by conventional plate clamping apparatus. The invention requires only the movement of one end portion of the top side plate clamp so that a less experienced operator can carry out the plate adjustment procedure in a short time.

2. Conventionally, plate adjustment has been manually performed, including loosening and fastening the bolts with a tool. The mechanism of the present invention enables automatic as well as manual operations. It is, therefore, possible to fully automate plate clamping and plate shifting or adjusting operations.

3. Since the mechanism of the present invention is quite simple, it can be installed in many conventional apparatus at a low cost. It is appreciated that the mechanism is advantageous in not only functional but also economical phases.

What is claimed is:

1. In a sheet printing machine having a plate cylinder formed with an axially directed recess in which is located a leading plate clamp and a trailing plate clamp, each having upper and lower vise members for holding the respective ends of a plate to releasably secure a plate to said cylinder, the improvement including a fulcrum pin at one end of said recess for mounting the lower vise member of said leading clamp, spring means interposed between the lower vise members for normally biasing the lower vise members of said leading plate clamp away from that of said trailing plate clamp, and actuating means opposite said fulcrum for pivoting said swingably mounted vise member about the fulcrum pin in opposition to said spring means, said actuating means comprising a shaft mounted to extend through the side wall of the recess and to be recriprocably movable therein, contact means formed at the inner end of said shaft for engaging the free end of said swingable vise member and means for selectively reciprocating said shaft to cause said swingable vise member to pivot about said fulcrum pin in response to the movement of said shaft to thereby adjust the position of the plate secured to the cylinder.

2. The apparatus according to claim 1, wherein said reciprocable shaft is threadedly mounted with the side wall of said cylinder plate roller, and said contact means comprises a wedge located at the end of said shaft and a roller mounted on the free end of said swingable vise member, whereby rotation of said shaft causes said wedge to advance or retract against said roller and pivot said swingable vise member.

3. The apparatus according to claim 1, wherein said shaft is slidably mounted in the side wall of said cylinder and said contact means is an eccentric cam located at the end of said shaft in engagement with the swingable vise member, whereby rotation of said shaft causes said eccentric cam to pivot said swingable vise member.

4. The apparatus according to claim 1, wherein said shaft is threadedly mounted in the side wall of said plate roller and said contact means comprises a wedge located at the end of said shaft and having a sloping surface, said swingable vise member being formed with a sloping surface at its free end conforming to the surface of said wedge whereby rotation of said shaft causes said wedge to advance and retract to pivot said swingable vise member.

5. The apparatus according to claim 1, wherein said shaft is slidably mounted in the side wall of said plate cylinder, said contact means comprises a wedge threadedly mounted on the tip of said shaft and having a sloping surface, a roller mounted on said swingable vise member in contact with said sloping surface, whereby rotation of said shaft causes said wedge to advance and retract to pivot said swingable vise member.

6. The apparatus according to claim 1, wherein said shaft is slidably mounted in the side wall of said plate cylinder and said contact means comprises a wedge threadedly mounted on the tip of said shaft, said lower vice member having a sloping surface in contact with said wedge.

7. The apparatus according to claim 1, including a gear mounted at the outer end of said shaft by which said shaft may be automatically moved.

* * * * *

UNITED STATES PATENT AND TRADEMARK OFFICE

CERTIFICATE OF CORRECTION

PATENT NO. : 5,168,810

DATED : December 8, 1992

INVENTOR(S) : Yasutaka Kojima

It is certified that error appears in the above-identified patent and that said Letters Patent is hereby corrected as shown below:

Col. 8, claim 2, line 47, "with" should be --within--.

Signed and Sealed this

Thirtieth Day of March, 1993

*Attest:*

STEPHEN G. KUNIN

*Attesting Officer*

*Acting Commissioner of Patents and Trademarks*